US005913595A

United States Patent [19]

Lin

[11] Patent Number: 5,913,595

[45] Date of Patent: Jun. 22, 1999

[54] LAMP SEAT TYPE LIQUID DECORATION

[76] Inventor: Rich Lin, No. 25-19, Janai Road, Chinshui Chuen, Tucheng Hsiang, Taipei Hsien, Taiwan

[21] Appl. No.: 08/888,833

[22] Filed: Jul. 7, 1997

[51] Int. Cl.[6] ..... F21S 1/12

[52] U.S. Cl. ..... 362/101; 362/806

[58] Field of Search ..... 362/234, 96, 101, 362/806

[56] References Cited

U.S. PATENT DOCUMENTS 3,174,688 3/1965 Chatten ..... 362/98
4,072,855 2/1978 Marchese ..... 362/101
4,170,035 10/1979 Walker ..... 362/96
4,974,127 11/1990 Foley ..... 362/96
5,272,604 12/1993 Lin ..... 362/96
5,678,918 10/1997 Lin ..... 362/96

*Primary Examiner*—Laura Tso
*Attorney, Agent, or Firm*—Dougherty & Troxell

[57] ABSTRACT

A lamp seat type liquid decoration in which liquid dynamic exhibition function and light function are combined to form a frame effect as injected by a flying disc.

9 Claims, 4 Drawing Sheets

LAMP SEAT TYPE LIQUID DECORATION

BACKGROUND OF THE INVENTION

The present invention relates to a lamp seat type liquid decoration in which liquid dynamic exhibition function and light function are combined to form a frame effect as injected by a flying disc.

There are many types of liquid decorations such as the applicant's U.S. patent application Ser. No. 5272604 "cyclonic liquid ornament" and No. 5426877 "dynamic liquid display structure" (as shown by Attachments 1 and 2). In No. 5272604, a vane is used to blow a liquid upward to inject the liquid out. In No. 5426877, a vane is used to create a downward centrifugal effect to form an eddy pattern. The detailed structural features of the above applications can be seen from the Attachments 1 and 2.

SUMMARY OF THE INVENTION

It is a primary object of the present invention to provide a lamp seat type liquid decoration in which a middle tube body is composed of inner, middle and outer layers of tube bodies fitted with each other for liquid dynamic exhibition function. A centrifugal vane is right located above the inner tube for creating an eddy force to suck the liquid and flash plates contained therein upward from the inner tube and discharge the same from the top exit of the inner tube toward the space of the outer layer. The liquid then flows downward through the outer layer back to the bottom entrance of the inner tube to form a continuous circulating system. The liquid entrains the flash plates to provide a dynamic exhibition effect in the space of the outer layer.

It is a further object of the present invention to provide the above liquid decoration in which a top seat is disposed at top end of the middle tube body. The top seat is designed with a flying disc pattern and disposed with illuminators therein. A base seat is disposed under the middle tube body. The upper surface of the base seat is disposed with a reflecting face for focusing and reflecting the light onto the flash plates in the middle tube body. The flash plates are entrained by the flowing liquid to form a bright flowing path as the flame injected from a flying disc.

It is still a further object of the present invention to provide the above liquid decoration in which a motor is disposed in the top seat to rotarily drive a main rotary wheel disposed with magnets therein. A driven rotary wheel is disposed above the middle tube body corresponding to the main rotary wheel. Magnetically attractive articles are disposed in the driven rotary wheel. The rotary shaft of the driven rotary wheel is passed through a bearing plate to rotarily drive a centrifugal vane for sucking the liquid upward from the inner tube. The conducting wires are extended from the base seat through the middle layer space of the middle tube body to the top seat for connecting with the motor, whereby the conducting wires can be hidden without being exposed outside. The liquid is contained in the close space and driven by the magnetically attracting force through the wall of the tube body without leakage.

The present invention can be best understood through the following description and accompanying drawings, wherein:

DETAILED DESCRIPTION OF THE PREFERRED EMBODIMENT

Figure 1:
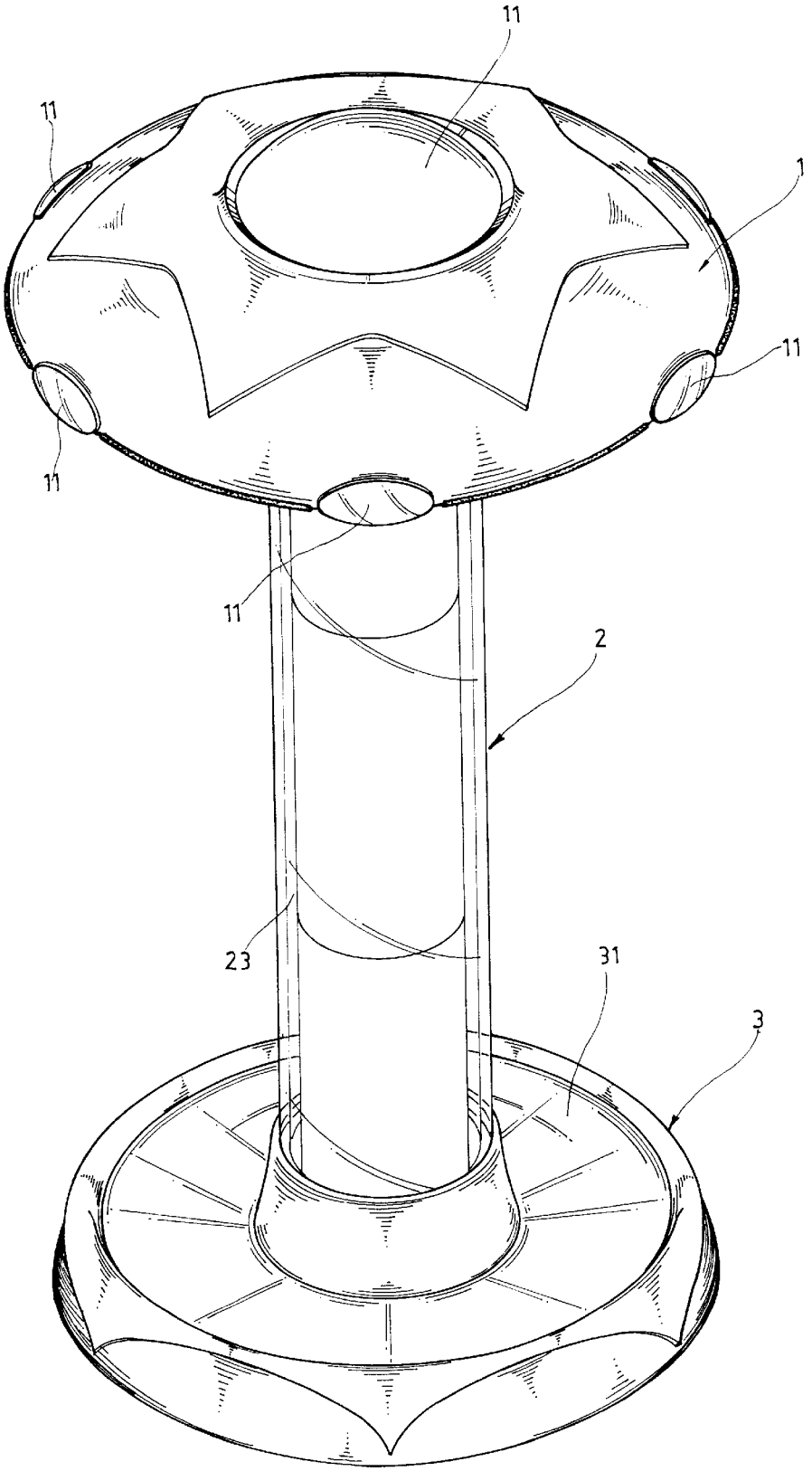
FIG. 1 is a perspective view of the present invention.
Figure 2:
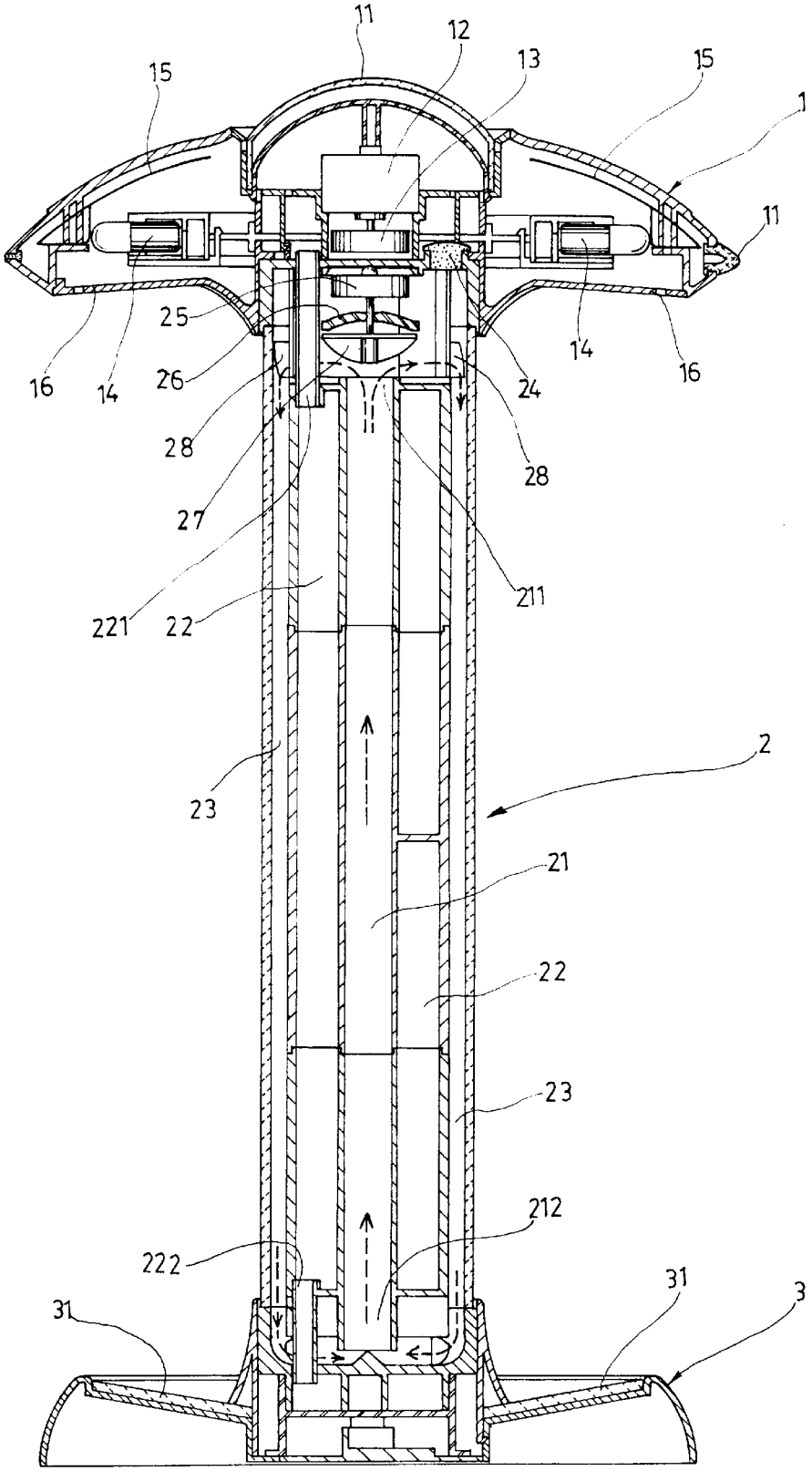
FIG. 2 is a side sectional view of the present invention.
Figure 3:
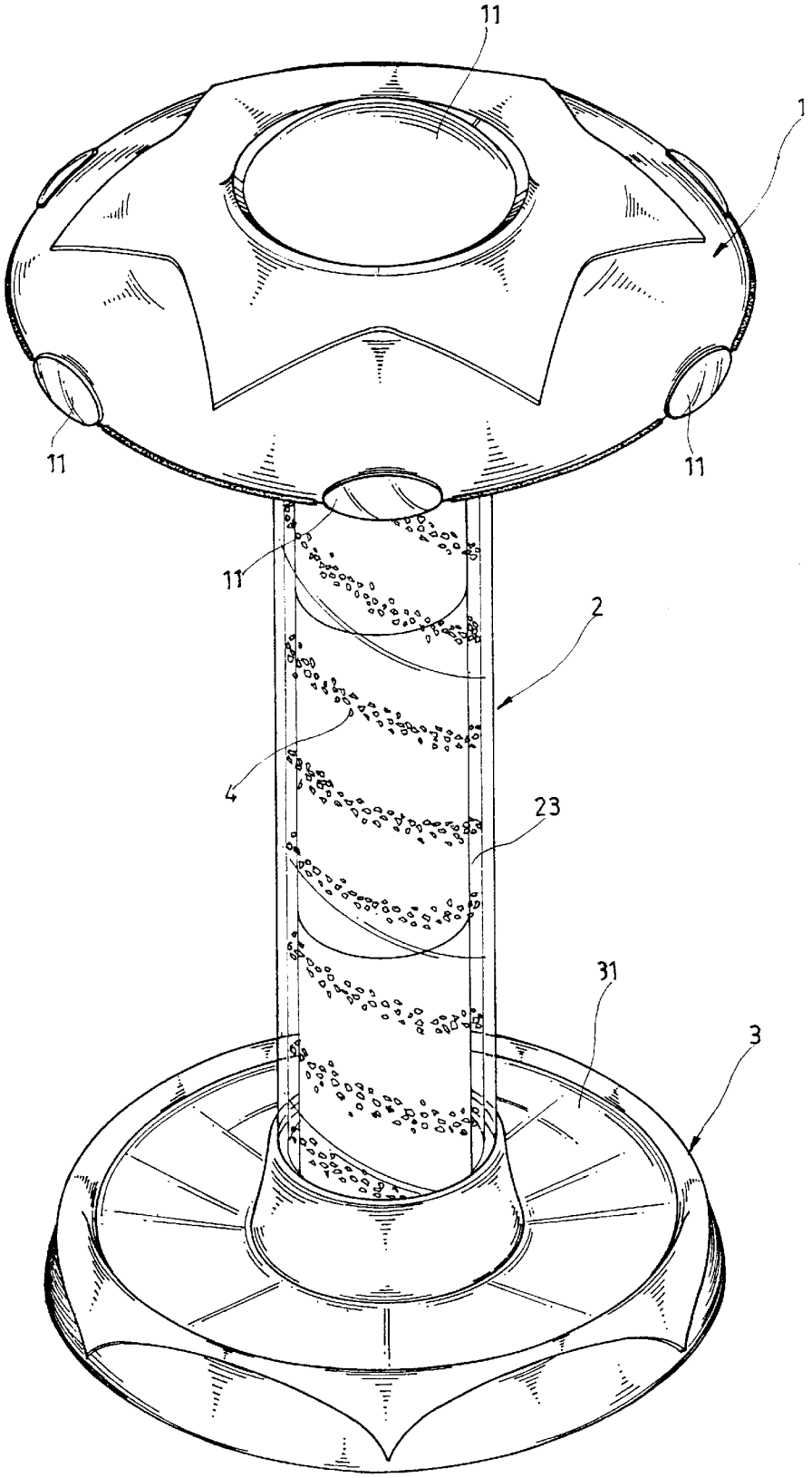
FIG. 3 is a perspective view showing the use of the present invention.

Please refer to FIGS. 1 and 2. The present invention includes a top seat 1, a middle tube body 2 and a base seat 3. The top seat 1 is designed with a disc pattern. The housing of the top seat 1 is disposed with multiple transparent faces 11 with different colors. A motor 12 is disposed at the center of the interior of the top seat and retained by a support. The rotary shaft of the motor 12 extends downward to drive a main rotary wheel 13 in which magnets are arranged. The main rotary wheel 13 can be stably and quickly rotated by the motor 12. A certain number of lamp seats 14 are disposed along the periphery of the interior of the top seat 1 to provide sufficient illumination. A reflecting plate 15 is disposed above each lamp seat 14, whereby most of the light can be projected downward through a transparent lower cover 16. The middle tube body 2 is composed of three layers of tube bodies fitted with each other with a certain diameters and heights. The middle tube body as a whole is fixedly connected between the top seat 1 and the base seat 3. The interior of the middle tube body 2 is defined with an inner tube 21, a middle layer 22 and an outer layer 23. The inner tube 21 and outer layer 23 are communicated with each other at top and bottom portions. The entire communicated space is filled with a liquid and a certain amount of flash plates. The uppermost edge of the top portion is disposed with a plug body 24 for filling the liquid, whereby the liquid and the flash plates can flow through the top portion and bottom portion between the inner tube 21 and outer layer 23 without leaking outside. The top exit 211 of the inner tube 21 is below the wall of the outer tube and a space is left above the exit 211. A driven wheel 25 is disposed in the space corresponding to the main rotary wheel 13. The rotary shaft of the driven wheel 25 abuts against the upper wall of the middle tube body 2. Magnetically attractive article are disposed in the driven rotary wheel 25 corresponding to the magnets of the main rotary wheel 13. When the main rotary wheel 13 is rotated, by means of the magnetically attracting force, the driven rotary wheel 25 spaced therefrom by the tube wall is simultaneously rotarily driven. A rotary shaft is connected under the driven rotary wheel 25 to pass through a bearing plate 26 for connecting with a centrifugal vane 27 right above the exit 211 of the inner tube 21 by a certain distance. When the vane 27 is rotated by a certain speed, an eddy force is exerted onto the liquid to suck and lift the liquid and flash plates through the inner tube 21 and spill out from the top exit 211 of the inner tube 21 to the space of the outer layer 23 and flow downward back to the communicating portion between the bottom portion of the outer layer 23 and the entrance 212 of the inner tube 21. Therefore, the entire liquid and flash plates flow as a continuous circulating system as shown by the phantom line of FIG. 2 to provide a dynamic exhibition effect. In order to enhance the exhibition effect of the flash plates 4, as shown in FIG. 3, multiple guide plates 28 with a spiral pattern are disposed on the circumferential face of the entrance of the outer layer 23, that is, the entrance for the liquid and flash plates to flow from the exit 211 of the inner tube 21 to the outer layer 23. Accordingly, the liquid and the flash plates can be divided into several flowing paths along the guide plates 28 to respectively flow downward spirally as shown in FIG. 3. The rails defined by the guide plates 28 create an inertial effect for the liquid and the flash plates during the downward flowing procedure. Therefore, through the entire height of the middle tube body 2, the flash plates 4 are kept spirally flowing downward.

In the middle tube body 2, except the communicated inner tube 21 and the outer layer 23, the space of the middle layer 22 is isolated from the liquid and can be communicated respectively with the top seat 1 and base seat 3 by an upper conducting tube 221 and a lower conducting tube 222, whereby the conducting wires can be directly passed from the interior of the base seat 3 through the interior of the middle tube body 2 to connect with the lamp seats 14 of the top seat 1. The base seat 3 is connected with an external power supply, whereby in use, except the conducting wires for connecting the base seat with the external power supply, no other conducting wire is exposed outside so as to keep the appearance of the entire body tidy.

Figure 4:
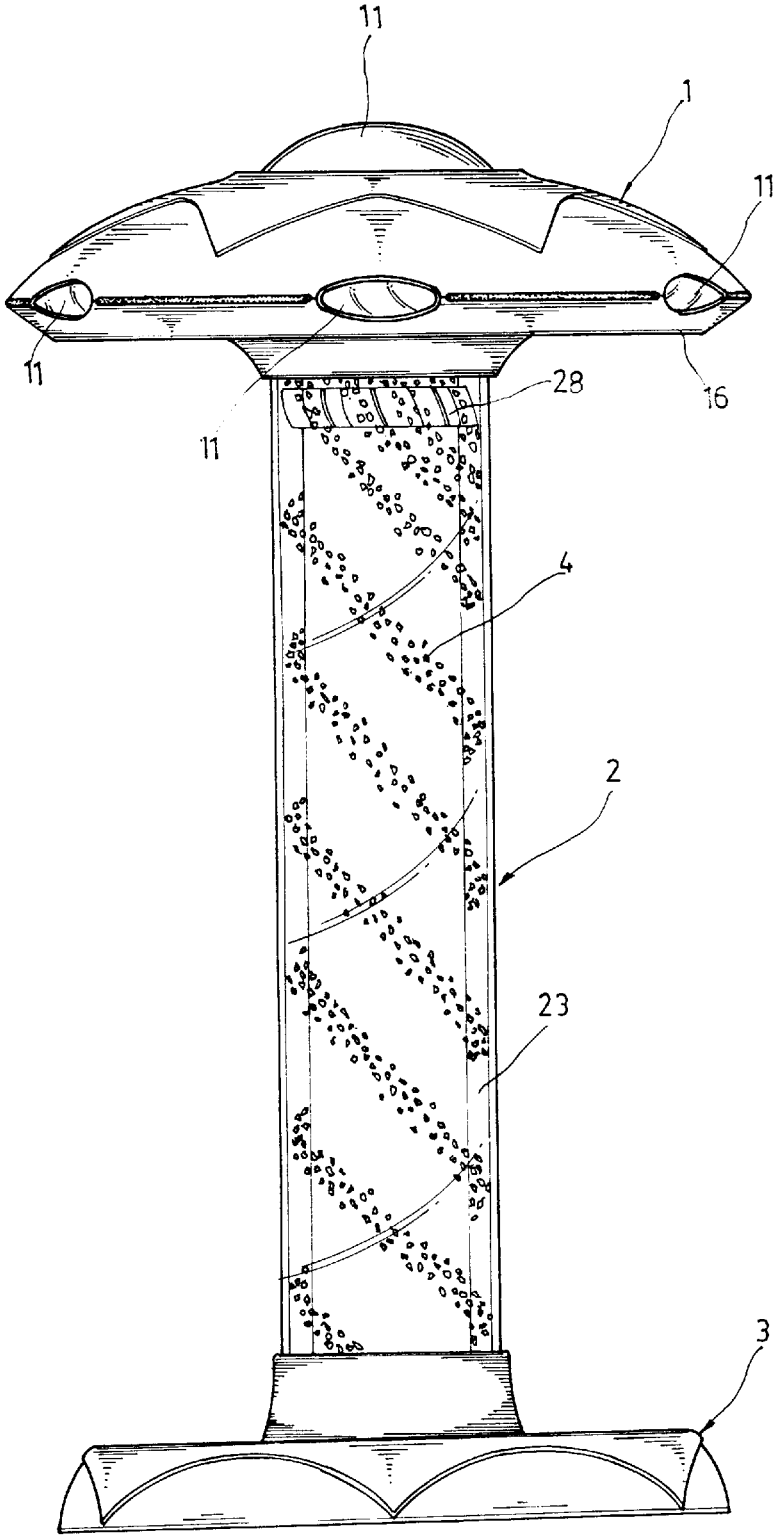
FIG. 4 is a side view according to FIG. 3.

The base seat 3 is disposed with internal conducting wires (not shown) and a reflecting mirror 31 on the upper surface, which is inclined toward the center. Accordingly, the light projected downward from the top seat 1 is reflected by the mirror 31 onto the middle tube body 2 to provide sufficient illumination and enhance the brightness of the flash plates 4. As shown in FIGS. 3 and 4, the light is emitted from the transparent faces 11 of the top seat 1 and the middle tube body 2 forms a bright tube body by means of the upward and downward projected light and the reflected light from the flash plates 4. When the flash plates 4 continuously flow downward spirally, the brightness also flows downward as a downward flame injected from the disc.

It is to be understood that the above description and drawings are only used for illustrating one embodiment of the present invention, not intended to limit the scope thereof. Any variation and derivation from the above description and drawings should be included in the scope of the present invention.

What is claimed is:

1. A lamp type liquid decoration comprising:

a top seat having a transparent lower cover, permitting light to be projected downward, the top seat having a disc pattern, multiple lamp seats being disposed along a periphery of an interior of the top seat, a motor being disposed at a center of the interior of the top seat, a rotary shaft of the motor extending downward to drive a main rotary wheel in which magnets are arranged;

a middle tube body fixedly connected between the top seat and a base seat, an interior of the middle tube body forming an inner tube, a middle layer and an outer layer with the middle layer and outer layer concentrically arranged about the inner tube; and a base seat having a reflecting mirror on an upper surface, which is inclined toward a center, whereby light projected downward from the top seat is reflected by the mirror onto the middle tube body.

2. A liquid decoration as claimed in claim 1, wherein a top portion and a bottom portion of the inner tube and outer layer of the middle tube body communicate with each other to form a closed space.

3. A liquid decoration as claimed in claim 1, wherein a plug body is disposed at a top portion of the middle tube body for filling therein a liquid and flash plates.

4. A liquid decoration as claimed in claim 1, wherein a space is left above a top exit of the inner tube of the middle tube body; and, a driven rotary wheel is disposed in the space.

5. A liquid decoration as claimed in claim 4, wherein a rotary shaft of the driven rotary wheel extends upward to abut against an upper wall of the middle tube body corresponding to the main rotary wheel in the top seat.

6. A liquid decoration as claimed in claim 5, wherein magnetically attractive articles are disposed in the driven rotary wheel to be magnetically attracted and driven by the main rotary wheel.

7. A liquid decoration as claimed in claim 6, wherein the rotary shaft of the driven rotary wheel extends downward to pass through a bearing plate and is connected with a centrifugal vane located above the top exit of the inner tube.

8. A liquid decoration as claimed in claim 7, wherein multiple guide plates arranged with a spiral pattern are disposed on a circumferential face of an entrance of the outer layer, whereby liquid and flash plates flow from the top exit of the inner tube to the outer layer, whereby the liquid and the flash plates are divided into a plurality of flowing paths along the guide plates to respectively flow downward spirally in a space bounded by the outer layer.

9. A liquid decoration as claimed in claim 1, wherein the middle layer is isolated from the inner tube and outer layer and communicates with the top seat and base seat by an upper conducting tube and a lower conducting tube, whereby conducting wires can be directly passed from an interior of the base seat through the middle layer to connect with the lamp seats of the top seat.

* * * * *